US008231822B2

(12) United States Patent
Petras et al.

(10) Patent No.: US 8,231,822 B2
(45) Date of Patent: Jul. 31, 2012

(54) METHOD FOR SPINNING A LIQUID MATRIX FOR PRODUCTION OF NANOFIBRES THROUGH ELECTROSTATIC SPINNING OF LIQUID MATRIX

(75) Inventors: David Petras, Zin (CZ); Miroslav Maly, Visnova (CZ); Martin Kovac, Cenkov (CZ); Vit Stromsky, Liberec (CZ); Jan Pozner, Liberec (CZ); Jan Trdlicka, Trebon (CZ); Ladislav Mares, Liberec (CZ); Jan Cmelik, Liberec (CZ); Frantisek Jakubek, Liberec (CZ)

(73) Assignee: Elmarco, S.R.O. (CZ)

( * ) Notice: Subject to any disclaimer, the term of this patent is extended or adjusted under 35 U.S.C. 154(b) by 39 days.

(21) Appl. No.: 12/669,236

(22) PCT Filed: Jul. 16, 2008

(86) PCT No.: PCT/CZ2008/000082

§ 371 (c)(1),
(2), (4) Date: Jan. 15, 2010

(87) PCT Pub. No.: WO2009/010020

PCT Pub. Date: Jan. 22, 2009

(65) Prior Publication Data

US 2010/0194000 A1 Aug. 5, 2010

(30) Foreign Application Priority Data

Jul. 17, 2007 (CZ) ..... 2007-485

(51) Int. Cl.
*B29C 33/72* (2006.01)
*D06M 10/00* (2006.01)
*H05B 7/00* (2006.01)

(52) U.S. Cl. ..... 264/465; 264/39

(58) Field of Classification Search ..... 264/465, 264/39

See application file for complete search history.

(56) References Cited

U.S. PATENT DOCUMENTS

| | | | | |
|---|---|---|---|---|
| 4,144,553 | A | 3/1979 | Schmidt et al. | 361/227 |
| 4,287,139 | A * | 9/1981 | Guignard | 264/10 |
| 2006/0049542 | A1 * | 3/2006 | Chu et al. | 264/465 X |

FOREIGN PATENT DOCUMENTS

CZ PV 2005-360 1/2007

(Continued)

*Primary Examiner* — Leo B Tentoni

(74) *Attorney, Agent, or Firm* — Ostrolenk Faber LLP

(57) ABSTRACT

Method for spinning the liquid matrix (38) in electrostatic field between at least one spinning electrode (3) and against it arranged collecting electrode (4), while one of the electrodes is connected to one pole of high voltage source and the second electrode is connected to opposite pole of high voltage source or is grounded, at which the liquid matrix (38) being subject to spinning is to be found in electrostatic field on the active spinning zone (3100) of the cord (310) of the spinning means (31) of the spinning electrode (3). The active spinning zone (3100) of the cord during spinning process has a stable position towards the collecting electrode (4) and the liquid matrix (38) to the active spinning zone (3100) of the cord is delivered either by application to the active spinning zone (3100) of the cord or by motion of the cord (310) in direction of its length. The invention further relates to the device for production of nanofibres and to the spinning electrode (3), whose active spinning zone (3100) of the cord in the carrying body (32) of the spinning electrode (3) has a stable position and to the cord (310) there is assigned the device (37) for application of the liquid matrix (38) to the cord (310), which is arranged in the carrying body (32) of the spinning electrode (3).

6 Claims, 11 Drawing Sheets

FOREIGN PATENT DOCUMENTS

| | | | |
|---|---|---|---|
| CZ | PV 2006-545 | | 1/2007 |
| CZ | PV 2007-179 | | 9/2008 |
| DE | 10136255 | A1 * | 2/2003 |
| WO | WO 2005/024101 | | 3/2005 |

* cited by examiner

METHOD FOR SPINNING A LIQUID MATRIX FOR PRODUCTION OF NANOFIBRES THROUGH ELECTROSTATIC SPINNING OF LIQUID MATRIX

TECHNICAL FIELD

The invention relates to the method for spinning of the liquid matrix in electrostatic field between at least one spinning electrode and against it arranged collecting electrode, while one of electrodes is connected to one pole of high voltage source and the second electrode is grounded, at which the liquid matrix being subject to spinning is in the electrostatic field on the active spinning zone of a cord of the spinning means of the spinning electrode.

Next to this the invention relates to the device for production of nanofibres through electrostatic spinning of liquid matrix in electric field between at least one spinning electrode and against it arranged collecting electrode, while one of electrodes is connected to one pole of high voltage source and the second electrode is connected to the opposite pole of high voltage source or grounded, and the spinning electrode contains at least one spinning member comprising the cord which contains the straight section parallel with the plane of depositing the nanofibres and/or with collecting electrode and it forms an active spinning zone of the cord.

Next to this the invention relates to the spinning electrode of the device for production of nanofibres through electrostatic spinning of liquid matrix in electric field between at least one spinning electrode and against it arranged at least one collecting electrode, while one of electrodes is connected to one pole of high voltage source and the second electrode is connected to opposite pole of high voltage source or grounded and the spinning electrode contains at least one in the carrying body of the spinning electrode mounted spinning member comprising the cord, which contains the straight section parallel with the plane of depositing the nanofibres and/or with the collecting electrode.

BACKGROUND ART

The DE 101 36 255 B4 discloses the device for production of fibres from solution or melt of polymer with spinning electrode formed of a system of parallel wires positioned on a pair of endless stripes belted around two guiding cylinders, which are positioned one above another, while the lower guiding cylinder extends into the solution or melt of polymer. The spinning electrode is connected to the high voltage source together with the counter-electrode, which is formed of electrically conductive rotating stripe. Solution or melt of polymer are carried out by means of wires into electric field between the spinning electrode and the counter-electrode, where from the solution or melt of polymer the fibres are created, which are carried towards the counter-electrode and they fall to the web positioned on the counter-electrode. The disadvantage is a long time of slaying of solution or melt of polymer in electric field, because the solution as well as the melt of polymer grows old quite quickly and during the spinning process it changes its properties which causes changes in parameters of created fibres, especially their diameter. Another disadvantage is positioning of wires of the spinning electrode on a pair of endless stripes, which must be electrically conductive and they affect very negatively an electric field being created between the spinning electrode and counter-electrode.

Further from the U.S. Pat. No. 4,144,533 there is known the device for electrodynamic applying of solutions, dispersions and mixtures of solid substances on substratum material by means of a suitable electric field. The device contains two reservoirs with applied substrate, in which there are positioned pulleys belted with endless stripe, by means of which the substrate is delivered into electric field, in which it is applied on the substratum material, which is passing next to one or both lateral sides of endless stripe. This device is not able to produce fibres, but it is designated only for applying of solutions, dispersions, etc.

Further there are known the devices for production of nanofibres through electrostatic spinning of polymer solution, which contain the rotation spinning electrodes of an oblong shape, e.g. according to the WO 2005/024101 A1. This device contains the spinning electrode in the shape of cylinder, which according to its main axis rotates and by its lower part of surface is dipped into polymer solution. The polymer solution by surface of the cylinder is carried out into electric field between the spinning and collecting electrode, where the nanofibres are formed, which are carried towards the collecting electrode and before it they deposit on the substratum material. This device is able to produce very good nanofibres from water polymer solutions, nevertheless the solutions of polymers soluble in nonaqueous solvents can be processed by means of this device quite difficult. Further, the layer of nanofibres applied on the substratum material is not even.

Evenness of the created layer of nanofibres may be achieved by means of the device according to the CZ PV 2005-360, which describes the spinning electrode comprising a system of lamellas arranged radial and longitudinally towards the rotation axis of the spinning electrode, while the wrapping surface of a part of surface of the spinning electrode serving for carrying out of the polymer solution into electric field have the wrapping surface, which in the plane passing through axis of the spinning electrode and perpendicular to the plane of substratum material has a shape formed of equipotential line of the highest intensity of electric field between the spinning electrode and collecting electrode. Such spinning electrode is able to carry out a sufficient quantity of polymer solution into the most suitable places of electric field between the spinning and collecting electrode and at the same time to spin quite good also the nonaqueous polymer solutions and to create an even layer of nanofibres. Nevertheless the disadvantage is the demanding production of such spinning electrode, and due to this its price.

As to the production, less costly seems to be the spinning electrode according to the CZ PV 2006-545, which comprises a pair of faces, between which there are mounted by wire formed spinning members distributed evenly around the perimeter of the faces, while the faces are produced of electrically non-conductive material and all spinning members are mutually electrically connected in a conductive manner. Rotating spinning electrode created in this way is able to spin the water as well as nonaqueous polymer solutions and along its whole length it achieves quite high spinning effect as to its evenness, while electric field for spinning is formed between individual spinning members after their getting out from polymer solution and gradual approaching towards the collecting electrode.

Disadvantage of all rotating spinning electrodes of an oblong shape as well as the device for production of nanofibres through electrostatic spinning of polymer solutions, that contain the rotating spinning electrodes of oblong shape is especially high quantity of polymer solution in reservoir of polymer solution into which the spinning electrodes extend by a section of their surface. The reservoirs have a large opened surface on which not only massive evaporating of solvent from polymer solution occurs but also e.g. at the solutions with hygroscopic solvents, the polymer solution thickens and grows old very fast and it must be added and replaced continuously. This increases the costs for production of nanofibres and at the same time reduces quality of produced nanofibres. The polymer solution into electrostatic field for spinning is delivered by surface of cylindric rotating spinning electrode relatively slowly, and so it gradually gets dry en the surface and at the next dipping of the respective place of surface of the rotation spinning electrode there gets stuck a greater quantity of polymer solution, which gradually causes degradation of the spinning process and surface of the spinning electrode must be cleaned. To clean the spinning electrode, the spinning process must be interrupted. At the cord rotation spinning electrode the polymer solution into electrostatic field is delivered on individual cords, which represent active spinning zones and which during spinning change their position in electrostatic field. This brings further disadvantage, as during spinning on the active spinning zone of the spinning electrode the intensity is of electrostatic field is changed, which results in production of nanofibres of various diameters and reduces qualitative evenness of produced nanofibres.

The goal of the invention is to propose a method and create device for production of nanofibres through electrostatic spinning of polymer solutions possibly of liquid matrixes containing especially polymer solutions in electrostatic field, which at the industrial utilisation would be able from the long-term period to produce nanofibres of a constant quality with the lowest possible demand for maintenance and adjustment and to design the spinning electrode, which would remedy or at least reduce disadvantages of the background art.

THE PRINCIPLE OF INVENTION

The goal of the invention has been reached through the method of spinning of the liquid matrix in electrostatic field according to the invention, whose principle consists in that the active spinning zone of the cord during spinning process has a stable position towards the collecting electrode and the liquid matrix to the active spinning zone of the cord is transported either by applying on the active spinning zone of the cord or by means of movement of the cord in direction of its length.

Stability and constancy in position of active spinning zone of the cord during spinning process secures evenness in creation of nanofibres in a narrow interval of diameters, which considerably increases the quality of produced nanofibrous layers. General increasing in quality of the spinning process is achieved through manner of transportation of the liquid matrix to the active spinning zone, which secures spinning of always fresh quality liquid matrix and optimises the spinning process. It is not necessary to interrupt the spinning process for the purpose to clean the spinning electrodes from the liquid matrix devalued through the previous cycles of spinning and/or by effect of surrounding atmosphere which got stuck on the active spinning zones of the spinning members of the spinning electrode.

It is advantageous if the liquid matrix is applied on the stationary active spinning zone of the cord in electrostatic field during spinning, while the liquid matrix devalued by spinning and/or by effect of surrounding atmosphere from the stationary active spinning zone of the cord is being wiped off. On the stationary active spinning zone of the cord, applying of the fresh liquid matrix as well as cleaning of surface of the cord from residuals of liquid matrix is performed during the spinning process, which increases productivity of the spinning.

To secure optimisation of the spinning process it is advantageous if the liquid matrix is applied in optional intervals for securing of its sufficient quantity and in other optional intervals the devalued liquid matrix is being wiped off.

From the point of view of quality of the spinning process it is advantageous if wiping off of the devalued liquid matrix is performed before applying the liquid matrix, and so the old and fresh liquid matrix is not mixed together.

Wiping off is with advantage performed before each applying of the liquid matrix, so that on the active spinning zone there is a sufficient quantity of a fresh liquid matrix without residuals of the devalued liquid matrix.

In case of the spinning electrode, which contains a greater quantity of active spinning zones arranged side by side in one plane, for the efficiency of the spinning process it is advantageous, when simultaneously there are wiped off several active spinning zones, which are not adjacent one to another mutually, so that during wiping off the spinning process is running on the adjacent active spinning zones.

Another possible embodiment of the method according to the invention is when the active spinning zone moves through electrostatic field in the direction of its length continuously or with breaks, which provides further possibilities of applying the liquid matrix on the active spinning zone and further possibilities for wiping off the devalued liquid matrix from surface of the cord and it enables to omit wiping off the devalued liquid matrix.

Similarly as at the previous embodiment, the liquid matrix may be applied on the active spinning zone of the cord in electrostatic field during spinning, this both on the standing and moving cord.

A method nevertheless enables applying of liquid matrix on the cord before the cord enters the active spinning zone which further increases possibilities in design of the device and spinning electrodes.

The principle of the device according to the invention consists in that the active spinning zone of the cord of the spinning member towards the collecting electrode has a stable position and to the cord there is assigned a device for applying the liquid matrix.

As it became apparent already at some solutions according to the background art, the cord formed of a thin wire represents a very suitable means for electrostatic spinning of liquid matrixes. A stable position of active spinning zone of the cord towards the collecting electrode brings stability in spinning conditions and due to this increases quality of produced nanofibres, especially stability of their diameters.

It is advantageous, if the cord is a stationary one and to its active spinning zone there is assigned a device for applying the liquid matrix to the active spinning zone and a device for wiping off the liquid matrix from the active spinning zone of the cord. The stationary cord simplifies the structure of spinning electrode, as such spinning electrode does not contain the means for driving of the cord and it does not require any means for continual stretching of the cord.

To secure a qualitative low variable liquid matrix for spinning, it is advantageous if the device for applying the liquid matrix on the active spinning zone of the cord and the device for wiping off the liquid matrix from the active spinning zone are arranged reversibly displaceably along the active spinning zone of the cord.

In cases when the cord is connected with high voltage source directly, and not through the delivered liquid matrix, it is advantageous if the device for applying and the device for wiping off the liquid matrix are arranged reversibly displaceably towards the active spinning zone of the cord, because in position distant from the active spinning zone of the cord these devices do not influence electrostatic field between the spinning electrode and collecting electrode, they do not influence negatively either the production of nanofibres or their parameters.

The cord is moveable in direction of its length, at the same time it is not decisive if it moves steadily or with breaks.

When compared with background art, during spinning by movement of the cord through electrostatic field in direction of length of the cord it is achieved that into electrostatic field, in which the spinning is running, the cord enters as a clean without liquid matrix devalued during the previous spinning cycles, so that on surface of the cord during spinning process only fresh liquid matrix is to be found, and it is not necessary to interrupt the spinning process for the purpose to clean the spinning electrode from the liquid matrix devalued by the previous spinning cycles and/or by effect of surrounding atmosphere and from the one got stuck on active spinning zones of the spinning members of the spinning electrode.

In an embodiment the cord of the spinning member has a definite length several times greater than the active spinning zone (3100) of the cord and its beginning is mounted on the unwinding reel, and its end is mounted on the winding reel, while at least the winding reel is coupled with the winding drive. At this embodiment, if the need may be, the cord enters into the active spinning zone of the cord without residuals of liquid matrix devalued during previous spinning cycles and/or by effect of surrounding atmosphere.

To achieve a sufficient stretching of the cord especially in its active spinning zone it is advantageous if the unwinding reel is coupled with the unwinding drive.

Another utilisation of the cord at the reverse motion after the definite length of cord is consumed enables arrangement, when before the winding reel there is arranged a spattle, serving for wiping off the residuals of devalued liquid matrix from the cord before its winding on the winding reel.

Another embodiment of the cord moving in a direction of its length is described, according to which the cord is formed of indefinite loop belted at least around the driving pulley and around the stretching pulley. This arrangement, in comparison with the previous embodiment, shortens the total length of the cord, nevertheless when compared with stationary cord it requires the drive assigned to the driving pulley.

Both the device with definite length of cord and the device with indefinite cord, which is formed of indefinite loop, may be with advantage performed with two active spinning zones in which the cord moves in an opposite direction. Both spinning zones are arranged in a plane parallel with plane of depositing the nanofibres and/or with the collecting electrode. This arrangement, next to others, enables to spin two liquid matrixes using one such cord.

Applying of the liquid matrix on the active spinning zone of the cord at embodiments with possibility of cord motion in direction of its length, with advantage may be performed. Reversibly displaceable device for applying the liquid matrix on the active zone of the cord the liquid matrix on the cord in the desired time as well as in the desired quantity, while the desired quantity of the liquid matrix applied on the mandrel may be achieved through multiple movement of the device for applying along the active spinning zone of the cord.

In cases when the cord is connected with high voltage source directly, and not through the delivered liquid matrix, it is advantageous if the device for applying the liquid matrix is arranged reversibly displaceably towards the active zone of the cord, because in position distant from the active spinning zone of the cord these devices do not influence electrostatic field between the spinning electrode and collecting electrode, they do not influence negatively either the production of nanofibres or their parameters.

The device for production of layer of nanofibres through electrostatic spinning of the liquid matrix in electric field usually comprises a greater number of spinning members arranged side by side. Alignment with the collecting electrode or with plane of collecting electrodes ensures evenness of the produced layer of nanofibres.

Also described are preferred embodiments of the applying device of the liquid matrix to the active spinning zone of the cord, which may be superseded by other suitable applying devices.

According to a more simple form of embodiment of device for applying the liquid matrix to the cord, the liquid matrix is applied on the cord before the active spinning zone. Though such arrangement simplifies organisation of the spinning area itself, in which the electrostatic field is not affected by the device for applying the liquid matrix, but to a less extend it meets the condition of even freshness of the liquid matrix on the active spinning zone of the cord.

With respect to the direction of taking off the produced layer of nanofibres the active spinning zone may be arranged parallel with this direction, perpendicular to this direction or trapezoidal to this direction.

At all above mentioned embodiments of the device according to the invention the cord may be made of electrically conductive material or of electrically non-conductive material, while in case of electrically non-conductive material of the cord the cord is in a permanent contact with the liquid matrix into which the electric current is supplied.

In the basic embodiment to the cord there is assigned the device for applying the liquid matrix, which is arranged in the carrying body of the spinning electrode, and the active spinning zone of the cord in the carrying body of the spinning electrode has a stable position.

DESCRIPTION OF THE DRAWING

The device according to the invention is schematically represented in the attached drawings, where the FIG. 1 shows a longitudinal section through a first variant of embodiment of the device with three spinning units, the FIG. 2 A-A section through the device according to the FIG. 1 with spinning electrodes, whose spinning members contain cords of definite length arranged parallel with direction of motion of the substratum material, the FIG. 3 A-A section through the device according to the FIG. 1 with spinning electrodes whose spinning members contain cords of definite length arranged askew to the direction of motion of the substratum material, the FIG. 4 shows A-A section through the device according to the FIG. 1 with spinning electrodes, whose spinning members contain the cords of definite length arranged perpendicular to the direction of motion of the substratum material, the FIG. 5 section of axonometric view to the spinning electrode with spinning members with indefinite length of the cord and displaceable applying device of the liquid matrix, the FIG. 6 section of axonometric view to the spinning electrode with spinning members with indefinite length of the cord with applying device of the liquid matrix formed of reservoir of liquid matrix, the FIG. 7 shows detail if the spinning member with definite length of the cord with displaceable applying device of the liquid matrix formed by capillaries, the FIG. 8 detail of the spinning member with definite length of the cord with displaceable applying device of the liquid matrix formed of rotating roller, the FIG. 9 detail of the spinning member with indefinite cord, whose both branches form the active spinning zone, the FIG. 10 longitudinal section through the device with spinning electrodes with fixed cords, and the FIG. 11A-A section through the device according to the FIG. 10.

EXAMPLES OF EMBODIMENT

Figure 1:
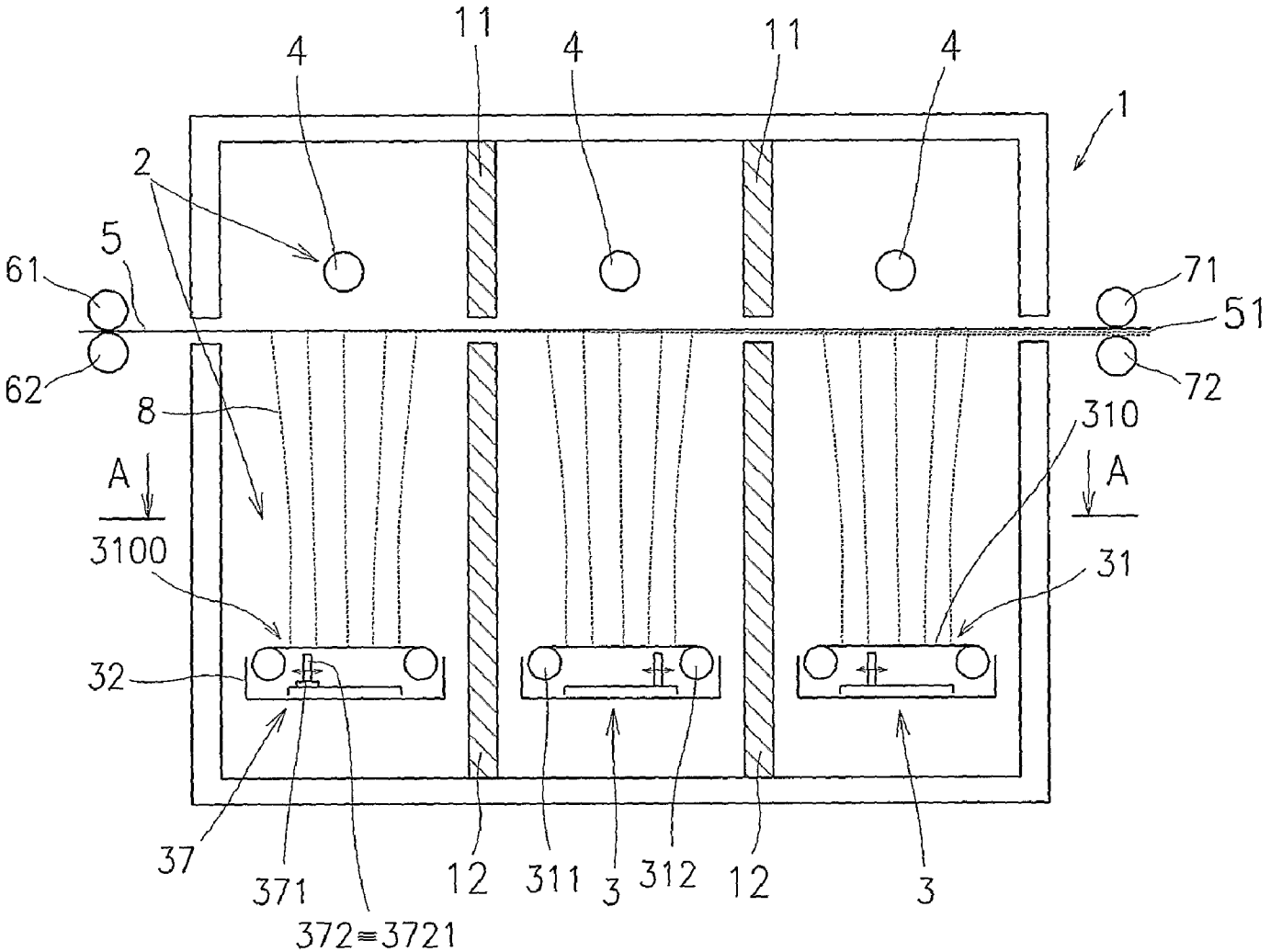
Figure 2:
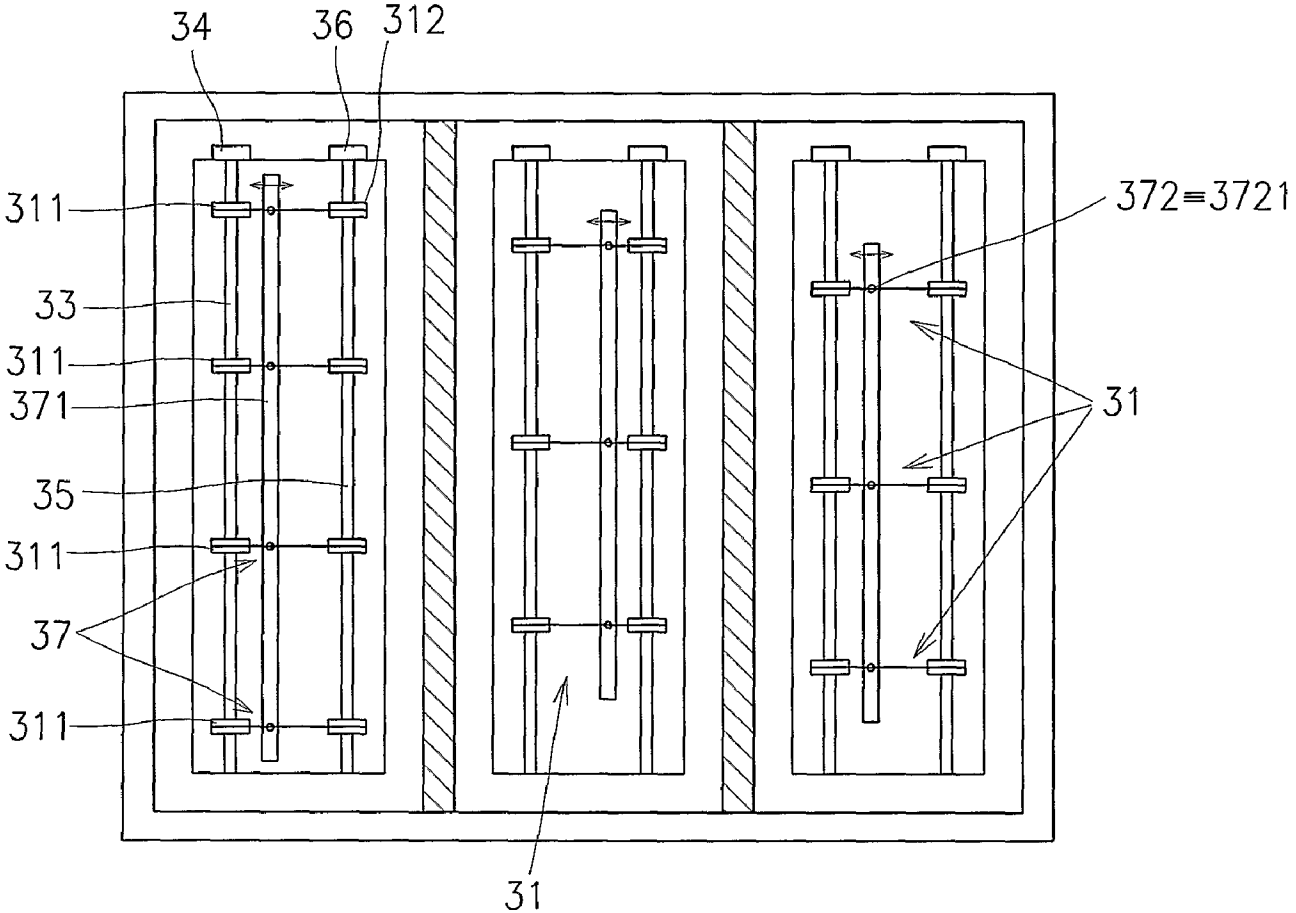

In the FIGS. 1 and 2 represented exemplary embodiment of the device for production of nanofibres through electrostatic spinning of the liquid matrix, whose substantial part is formed by the solution or melt of polymer or mixture of polymers, comprises the spinning chamber 1, which by means of insulation partitions 11, 12 is divided into three spinning spaces in which there are arranged the spinning units 2, out of which each contains the spinning electrode 3 and against it arranged the collecting electrode 4. Between the spinning electrode 3 and the collecting electrode 4 electrostatic field of high intensity is created in a known manner. In the spinning chamber 1 in a known not closer specified manner is performed the passage for the substratum material 5, which is being unwound in the known not represented unwinding device and into the spinning chamber 1 it is brought by means of feeding rollers 61, 62. From the spinning chamber 1 the substratum material 5 is taken off by means of take-off rollers 71, 72, behind which in a known not represented manner it is being wound the in the not represented winding device. Here described insulation partitions 11, 12 serve only to mutual screening of in sequence following spinning units 2 and they are not substantial for the submitted invention.

The spinning electrode 3 contains several spinning members 31 arranged in the carrying body 32. Each spinning member 31 contains one cord 310, which is mounted on the unwinding reel 311 and on the winding reel 312, while the unwinding reel 311 and the winding reel 312 at the same time serve as the stretching means of the cord 310. The straight section of the cord 310 between the unwinding reel 311 and winding reel 312 is parallel with direction of motion of the substratum material 5 and it creates the active spinning zone 3100 of the cord 310 of the spinning member 31. The cord 310 is made of a thin metal wire which is electrically conductive or of a plastic line which is electrically not conductive.

The unwinding reels 311 of the spinning members 31 of one spinning electrode 3 are mounted on a common unwinding shaft 33, which is mounted in the carrying body 32 and is coupled with the unwinding drive 34. The winding reels 312 of the spinning members 31 of one spinning electrode 3 are mounted on a common winding shaft 35, which is mounted in the carrying body 32 and it is coupled with the winding drive 36. The unwinding drive 34 and winding drive 36 are in a known manner coupled, either mechanically or electrically, to secure the necessary stretching of the cord 310 in its active spinning zone 3100 and to secure a continuous or interrupted forward motion of the cord 310 in its active spinning zone 3100. The cord 310 of each spinning member 31 is therefore positioned displaceably in direction of its length, which means that the active spinning zone 3100 of each cord moves through electrostatic field continuously or with intervals in direction of its length. The active spinning zones 3100 of the cords 310 of all spinning members 31 of one spinning electrode 3 are arranged in a plane, which is parallel with the collecting electrode 4 and with substratum material 5.

Under the active spinning zones 3100 of the cords 310 of spinning members 31 of one spinning electrode 3 on the carrying body 32 is mounted the device 37 for application of the fluid matrix 38 to the active spinning zones 3100 of the cords. Each of the cords 310 therefore creates the carrying means of the fluid matrix 38. The device 37 for application of the fluid matrix contains the spar 371 displaceably mounted on the carrying body 32 and coupled with the known not represented drive for securing of its reversible motion along the length of active spinning zones 3100 of the cords. On the spar 371 under each active spinning zone 3100 of the cord there is mounted one application means 372, which in the represented embodiment is formed of capillary application means 3721. Cavity of the capillary application means 3721 is connected with cavity in the spar 371, which in a known not represented manner is connected to the not represented reservoir of fluid matrix 38. The fluid matrix 38 earlier than it reaches the cavity of capillary application means 3721 is passing through the known not represented electrical member, which is connected to one pole of source of electrical potential and the fluid matrix 38 then brings the necessary electrical potential to the active spinning zone 3100 of the cord, which enables creating of electrostatic field of a high intensity between the active spinning zone 3100 of the cord of the corresponding spinning member 31 and the collecting electrode 4 of the respective spinning unit 2. This electrostatic field of high intensity is able from the fluid matrix 38, being found on the active spinning zone 3100 of the cord, in a known manner to withdraw the beams of fluid matrix 38, which in electrostatic field of high intensity fall into nanofibres 8, which by acting of electrostatic field of a high intensity are carried to the collecting electrode 4 and they deposit on the substratum material 5, on which they create the nanofibrous layer 51. The fluid matrix 38 may further contain another substances, which in a desired way modify properties of the produced nanofibres.

The fluid matrix 38 to the active spinning zone 3100 is applied in electrostatic field during the spinning through motion of the device 37 for application the fluid matrix 38 under active spinning zones 3100 of the cords. In the described example of embodiment according to the FIG. 1 during applying, the application means 372 is moving which is in contact with active spinning zone 3100 of the standing cord 310. Nevertheless motion of the cord 310, in other words of its active spinning zone 3100 during application of the fluid matrix 38 is not excluded.

At embodiment according to the FIG. 2 in direction of the substratum material 5 three spinning units 2 are arranged one after another, out of which on the picture are represented three spinning electrodes 3. The first spinning electrode 3 contains four spinning members 31 arranged in the carrying body 32 in the same distance one from another. The second and the third electrode 3 contains three spinning members 31 arranged in the same mutual distance, while in direction of motion of the carrying material 5 the spinning means 31 of one after another following spinning electrodes 3 are arranged in space between the spinning means 31 of the previous spinning electrode 3, which reduces forming of stripes of nanofibrous layer 51 or it prevents forming of stripes totally.

Elimination of stripes forming in the resultant nanofibrous layer 51 may be achieved also by other methods, e.g. according to the not represented embodiment, which comprises at least two spinning electrodes 3 with equal number of spinning members 31, which are in the carrying bodies 32 arranged in equal position and with equal mutual distance. The different positions of the spinning members 31 of one after another positioned spinning electrodes 3 is achieved through setting the position of carrying bodies 32 of one after another following spinning electrodes 3.

Figure 3:
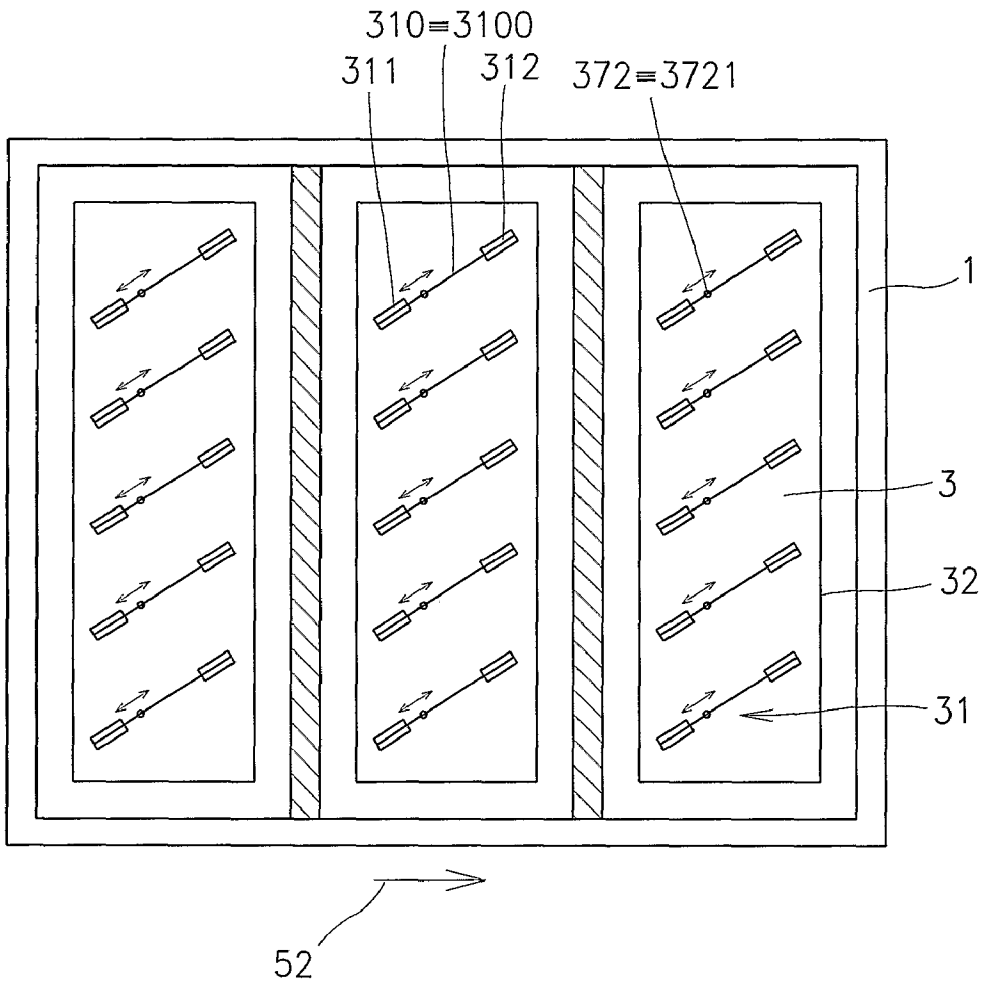

At the example of embodiment according to the FIG. 3 in the spinning chamber 1 are arranged three spinning units, of which are represented the spinning electrodes 3, while the inner space of the spinning chamber 1 is not separated by means of insulation partitions between the spinning units as at the previous embodiment. The spinning electrodes 3 contain the carrying bodies 32, in which askew to the direction 52 of motion of the substratum material are arranged the spinning members 31 performed in the same manner as in the previous exemplary embodiment. Unwinding reels 311 as well as the winding reels 312 of the spinning members are provided with the known not represented individual drives, which are coupled to ensure the necessary stretching of the cord 310 in the active spinning zone 3100 and to ensure a continual or interrupted motion of the cord 310 in direction of its length. The application means 372 of the fluid matrix 38 are mounted displaceably under the active spinning zones 3100 of the cords. The device works in the same manner as the above described embodiment according to the FIGS. 1 and 2.

Figure 4:
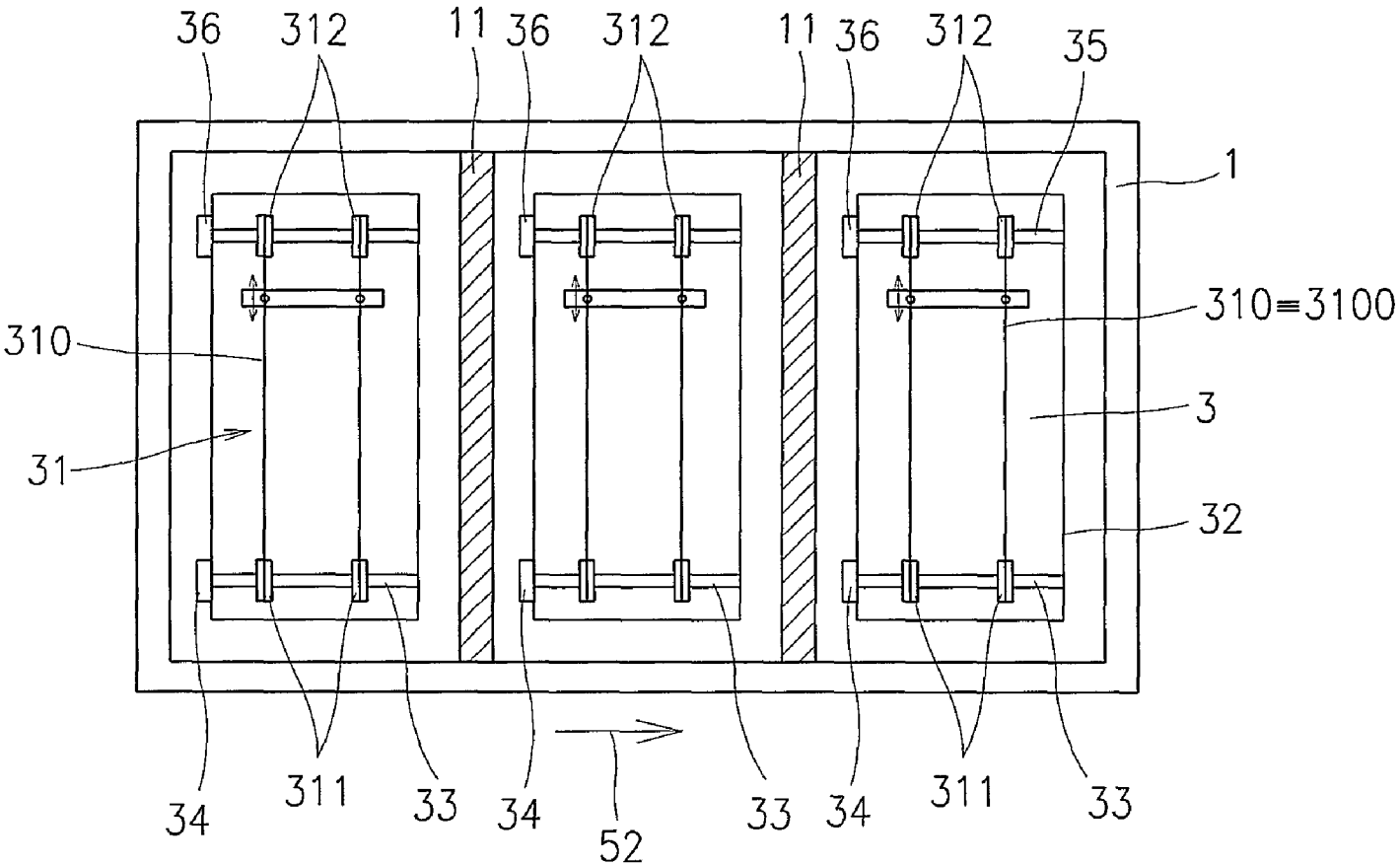

At the example of embodiment according to the FIG. 4 the spinning chamber 1 comprises three spinning units 2 separated one from another by insulation partitions 11. From the spinning units represented are the spinning electrodes 3, which comprise the carrying bodies 32, in which perpendicular to direction 52 of motion of the substratum material 5 are arranged the spinning members 31 performed in the same manner as at embodiment according to the FIGS. 1 and 2. Unwinding reels 311 of the spinning members 31 of one spinning electrode 3 are mounted on the common unwinding shaft 33 that is mounted in the carrying body 32 and is coupled with the unwinding drive 34. Winding reels 312 of the spinning members 31 of one spinning electrode 3 are mounted on the common winding shaft 35, that is mounted in the carrying body 32 and is coupled with the winding drive 36. The necessary stretching of the cord 310 in the active spinning zone 3100 is achieved by a linkage between the unwinding drive 34 and winding drive 36 of the spinning electrode 3. The active spinning zones 3100 of the cords 310 of all spinning members 31 of one spinning electrode 3 are arranged in a plane, which is parallel with the collecting electrode 4 and with the substratum material 5. The device works in the same manner as embodiment according to the FIGS. 1 and 2.

Figure 10:
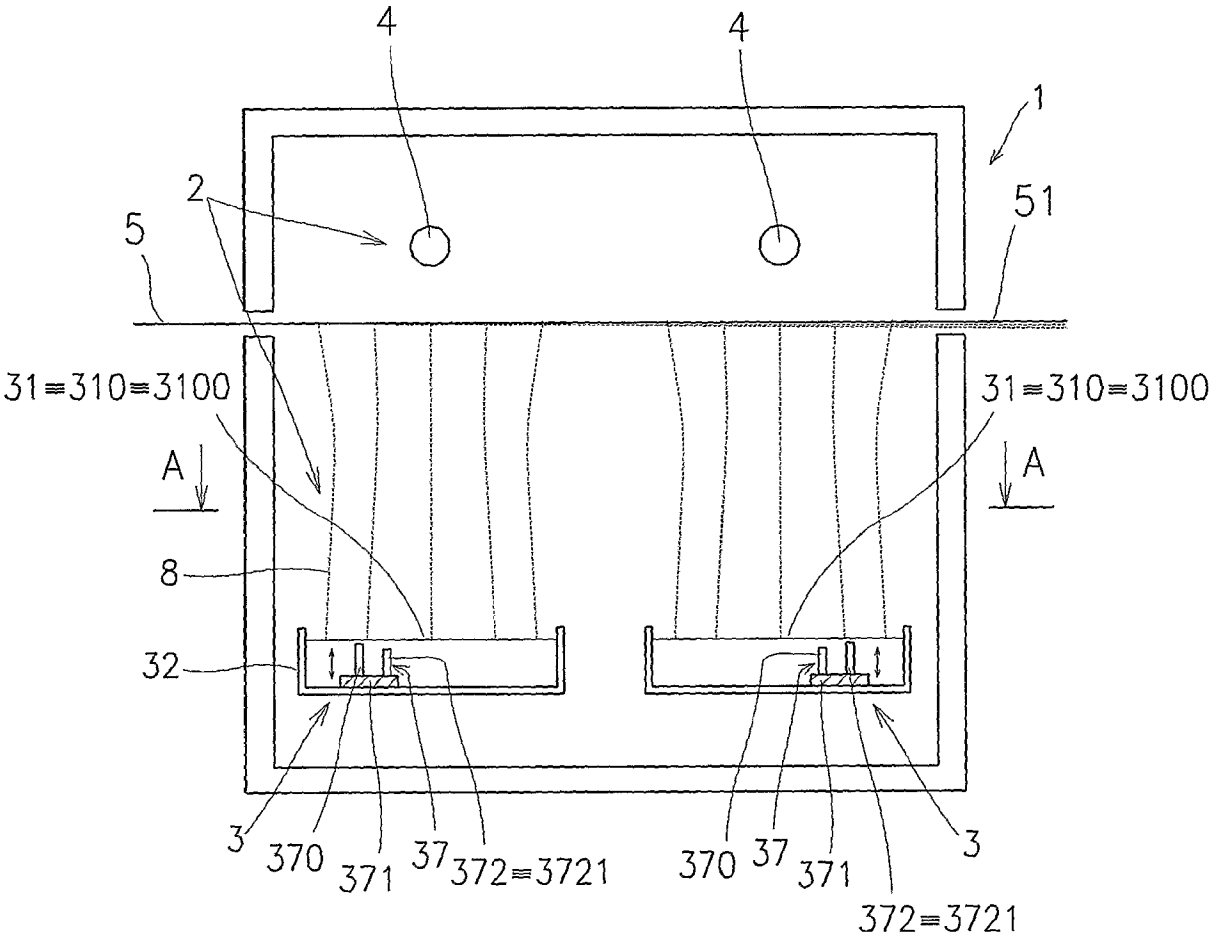
Figure 11:
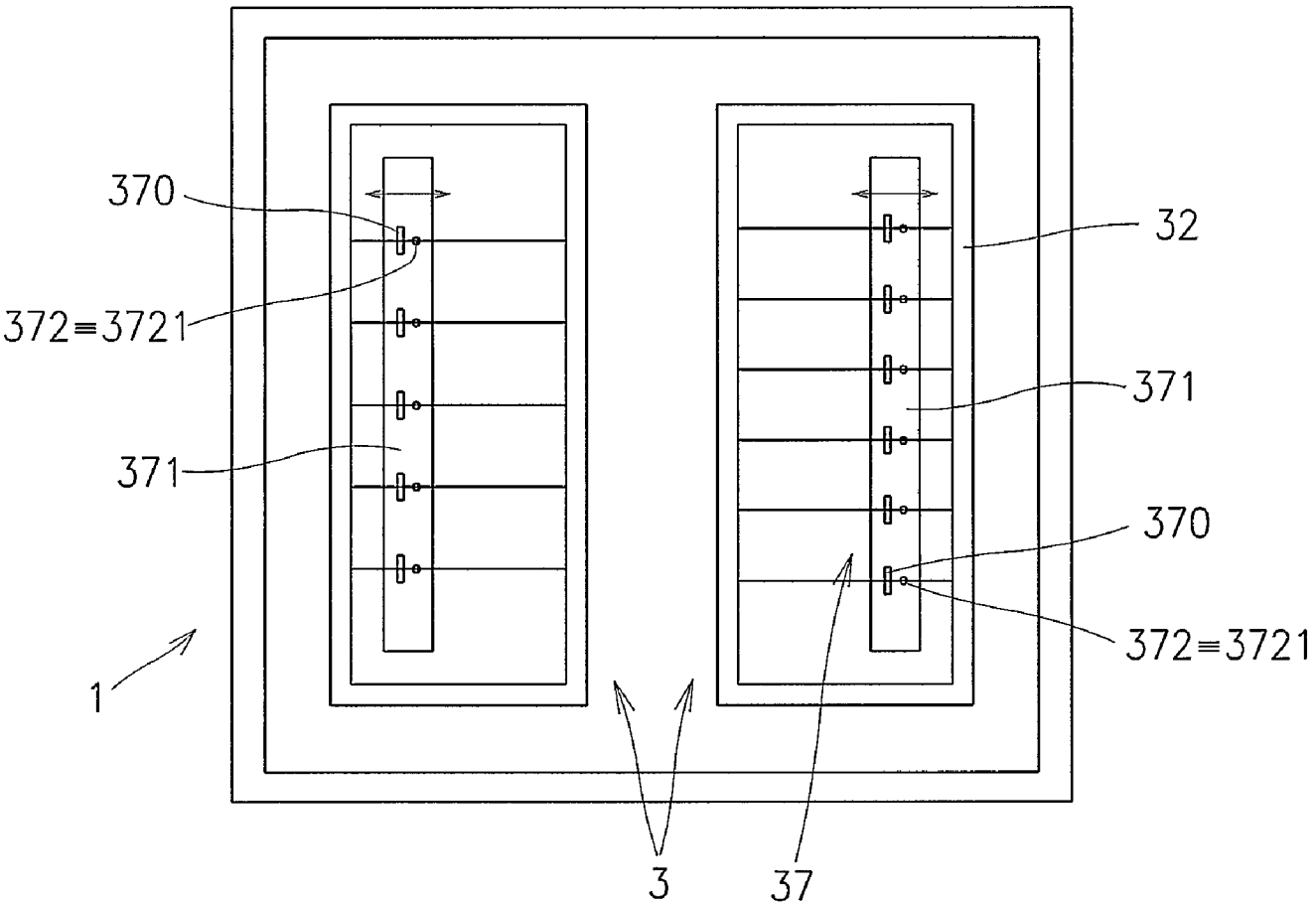

The FIGS. 10 and 11 represents another alternative embodiment according to the invention, at which in the spinning chamber 1 are arranged two spinning units 2, out of which each comprises the spinning electrode 3 and against it arranged collecting electrode 4, between which in a known manner is performed the electrostatic field of high intensity. In the spinning chamber 1 is performed a passage for the substratum material 5, on which during spinning the nanofibres 8 are deposited into the layer 51 of nanofibres. Each spinning electrode 3 contains the carrying body 32, between whose side walls in a certain distance one from another are stretched the independent cords 310, which in the side walls of the carrying body 32 are firmly mounted, they are of a definite constant length and are parallel with the plane of substratum material 5. Individual cords 310 form the spinning members 31 and nearly whole their length forms the active spinning zone 3100 of the cord.

In the represented embodiment the cords 310 are in the direction of taking-off the produced nanofibrous layer 52 of the following spinning electrodes 3 situated between the cords 310 of the preceding spinning electrode 3, which contributes to reduction in forming of stripes of the produced nanofibrous layer 52 or it nearly eliminates forming of stripes.

Under the active spinning zones 3100 of the cords 310 of each spinning electrode 3 on the carrying body 32 displaceably is mounted the device 37 for application of the liquid matrix 38 to the active spinning zones 3100 of the cords. The device 37 for application of the liquid matrix comprises the spar 371 displaceably mounted on the carrying body 32 and coupled with the not represented drive to secure its reversible motion along the active spinning zones 3100 of the cords. Under each active spinning zone 3100 on the spar 371 is mounted one application means 372 of the liquid matrix 38 formed in the represented embodiment by the application means 3721, which is simultaneously arranged reversibly displaceably in direction to the active spinning zone 3100 of the cord and from it. On the spar 371 there is further arranged the device 370 for wiping off the liquid matrix 38 from the active spinning zone 3100 of the cord which is simultaneously independently on the application means 372 arranged reversibly displaceably in direction of the active spinning zone 3100 of the cord and from it.

Electrical potential is to the active spinning zones 3100 brought through their connection to one pole of the source or through grounding.

If the electrical potential to the active spinning zones 3100 of the cord is brought by means of the liquid matrix 38, as it is in detail described at embodiment according to the FIG. 1, the application means 372 is in a permanent contact with the respective active spinning zone 3100 of the cord.

In the not represented embodiment the application means 372 of the liquid matrix 38 are arranged for each active spinning zone 3100 of the cord independently. The device 370 for wiping off the liquid matrix 38 for each active spinning zone 3100 are arranged separately independent on the application means 372 or together with them. According to their arrangement, the application means 372 of the liquid matrix and the device 370 for wiping off the liquid matrix 38 enable various combinations of their activity.

For example the liquid matrix 38 is applied to the stationary active spinning zone 3100 during spinning and the active spinning zone 3100 is in a constant contact with to it corresponding application means 372 of the liquid matrix 38, through which to the active spinning zone 3100 the electrical potential is brought simultaneously. The liquid matrix 38 devalued, through spinning and/or by action of surrounding atmosphere is from the active spinning zone 3100 wiped off in case of need.

Or the liquid matrix 38 is applied to the stationary active spinning zone 3100 during spinning and the active spinning zone 3100 is to it corresponding application means 372 in contact only during the period of application, and after then the application means 372 is from the active spinning zone 3100 of the cord taken away and does not touch it. The liquid matrix 38 devalued by spinning and/or by effect of surrounding atmosphere is from the active spinning zone 3100 wiped off in the same way as in the previous embodiment in case of need.

The liquid matrix 38 to the stationary active spinning zone 3100 of the cord in electrostatic field may be applied in opt ional intervals, and in other optional intervals the devalued liquid matrix 38 may be wiped off from the active spinning zone.

Wiping off the devalued liquid matrix 38 may be performed before application of the liquid matrix 38 to the active spinning zone 3100 of the cord and it may be performed before each application of the liquid matrix 38.

Wiping off the got stuck devalued liquid matrix 38 from the active spinning zone 3100 of the cord at the spinning electrodes 3 containing more active spinning zones 3100 of the cords arranged side by side in one plane is performed simultaneously on more active spinning zones 3100 of the cords, while between one after another following active spinning zones 3100 of the cords being wiped off, always at least one active spinning zone 3100 of the cord is to be found with the applied liquid matrix 38, which at this time is not being wiped off.

The active spinning zone 3100 of the cord, which is firmly and without possibility of movement arranged in the carrying body 32 of the spinning electrode 3, may be arranged parallel with the direction 52 of motion of the substratum material 5 or with the direction of taking off the produced nanofibrous layer 52, as it is represented in the FIGS. 10 and 11. Or the active spinning zone 3100 may be of the direction perpendicular to the above mentioned direction 52 of motion of substratum material 5 or it may with this direction form any desired angle.

Figure 5:
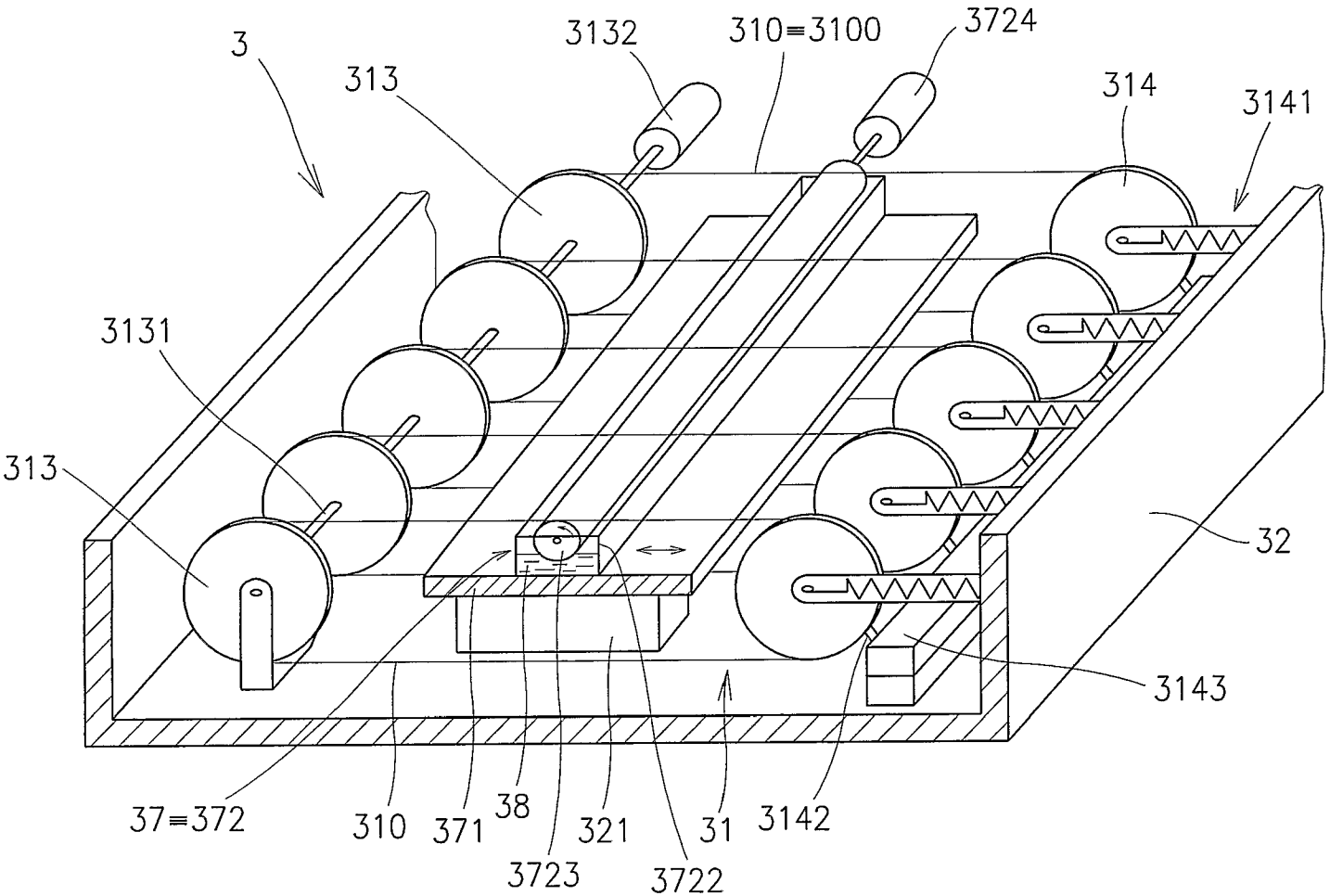

The spinning electrode 3 represented in the FIG. 5 contains the carrying body 32 in which are arranged the spinning members 31. Each spinning member 31 comprises the driving pulley 313 and the stretching pulley 314, which are belted by infinite cord 310, whose straight section adjacent to the collecting electrode 4 forms the active spinning zone 3100. The active spinning zones 3100 of the cords 310 of all spinning members 31 of one spinning electrode 3 are arranged flush. If the spinning electrode 3 is in the spinning chamber 1 of the device, it is parallel with the collecting electrode 4 and with the substratum material 5. The driving pulleys 313 of all spinning members 31 of one spinning electrode 3 are mounted on a common shaft 3131 of the driving pulleys, which is rotatably mounted in the carrying body 32 and coupled with the drive 3132 of driving pulley. The drive 3132 serves to produce continuous or interrupted rotation motion of the shaft 3131 of the driving pulleys 313. Each stretching pulley 314 of individual spinning members 31 is mounted on the stretcher 3141, which ensures position of the stretching pulley 314 and the necessary stretching of infinite cord 310.

Between the spinning members 31 on the carrying body 32 are mounted at least two supports 321, on which across all the spinning members 31 is arranged the spar 371, on which also across all the spinning members 31 is mounted the device 37 for application of the fluid matrix 38 to the active sections of the spinning zones 3100 of the cords 310. The device 37 for application of the fluid matrix 38 in embodiment according to the FIG. 5 comprises the reversibly displaceably in the direction of length of active spinning zones 3100 of the cords 310 arranged application means 372 formed of from above opened reservoir 3722 of the fluid matrix 38, in which is rotatably mounted the application roller 3723, whose upper section is in contact with the active spinning zones 3100 of all cords 310 of the spinning members 31 of the respective spinning electrode 3. The application roller 3723 is coupled with the drive 3724 of the application roller. Reservoir 3722 of the fluid matrix 38 is coupled with the known not represented drive, which secures its reversible or interrupted motion under the active spinning zones 3100 of the cords. By motion of 3722 or by the whole device 37 for application of the fluid matrix 38 along the active spinning zone 3100 of the cord the application of the liquid matrix is ensured to the active spinning zone 3100 of the cord.

The application roller 3723 may at alternative not represented embodiment be replaced by a system of disks which by lower section of their perimeter are dipped into the liquid matrix 38 and upper section of their perimeter is in contact with active spinning zone 3100 of the respective cord 310. Or the device 37 for application of the liquid matrix 39 may contain the capillary application means 3721 as at embodiment according to the FIGS. 1 to 4, possibly other suitable application means.

In the represented embodiment to the lower part of each stretching pulley 314 are assigned the wiping off means 3142 of the non-fibrous liquid matrix 38, which was not subjected to spinning in the active spinning zone 3100. The wiping off means 3142 lead into the auxiliary reservoir 3143.

During spinning at this embodiment the cord 310 in its active spinning zone 3100 may move permanently and continuously or it may move in an interrupted manner. In case of a continuous motion of the cord 310 the device 37 for application of the fluid matrix 38 is situated close to the driving pulleys 313 and the fluid matrix 38 is continuously applied onto a slowly moving cords 310 of individual spinning members 31. Application of the fluid matrix 38 is performed by rotation of the application roller 3723, which by its circumference carries out the liquid matrix 38 from the reservoir 3722. The cords 310 are brought into motion by the driving pulleys 313 and stretched by the stretchers 3141. After passage of the cord 310 through its active spinning zone 3100 the non fibrous liquid matrix 38, which is devalued by the spinning process and/or the effect of surrounding atmosphere, is wiped off by means of the wiping off means 3142 assigned to the stretching pulley 314 and is taken off into the auxiliary reservoir 3143. In case of interrupted motion of the cord 310 application of the liquid matrix 38 is performed by motion of the device 37 for application of the liquid matrix along the active spinning zones 3100 of the cords, while the application roller 3723 rotates and carries out by its perimeter the liquid matrix 38 from the reservoir 3722. After application of the liquid matrix 38 to the active spinning zones 3100 of the cords the device 37 for application of the liquid matrix takes one its extreme positions and either remains in contact with the cord 310, which is made of conductive or non conductive material, and transfers to it the electrical potential or it draws away from the cord 310 in cases when the electrical potential is brought to the active spinning zone 3100 of the cord by another manner.

Figure 6:
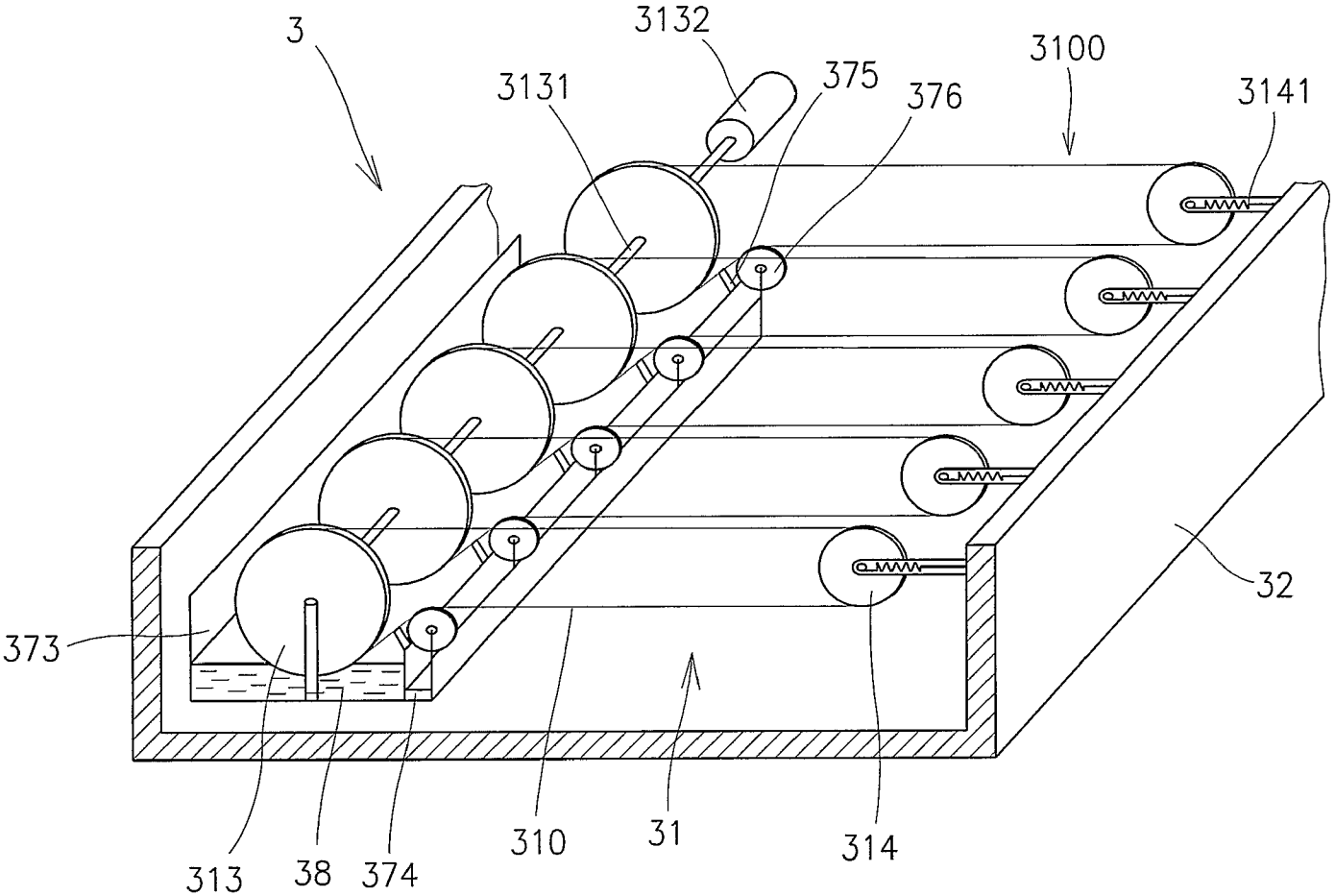

Another embodiment of the spinning electrode 3 is represented in the FIG. 6. The spinning members 31 are arranged in the carrying body 32 similarly as at the embodiment according to the FIG. 5 and they contain the driving pulley 313 and the stretching pulley 314, which are belted by the infinite cord 310, whose straight section adjacent to the collecting electrode forms the active spinning zone 3100, while the active spinning zones 3100 of all spinning members 31 of one spinning electrode 3 are arranged in uniplanar manner. The stretching pulleys 314 of the cords 310 of the spinning members 31 in the carrying body 32 are arranged in the same manner as in example of embodiment according to the FIG. 5 on the stretchers 3141. The driving pulleys 313 of all spinning members 31 of one spinning electrode 3 are mounted on the common shaft 3131 of the driving pulleys, which is rotatably mounted in the stationary reservoir 373, which is partially filled with the liquid matrix 38 and which is firmly mounted in the carrying body 32. The driving pulleys 313 extend by a section of their by the cord 310 belted circumference under the level of the liquid matrix 38 in stationary reservoir 373, which at this embodiment forms the device 37 for application of the liquid matrix 38 to the cord 310, while into the active zone 3100 the cord 310 enters with applied liquid matrix 38 for spinning. From the side of entry of the reversible portion of the endless cord 310 in the stationary reservoir 373 is performed the waste reservoir 374, which is provided with spattles 375, through which the cords 310 are guided before their entry to the driving pulley 313. By acting of the spattle 375 from the cord 310 are removed the residuals of the liquid matrix 38, which was not subjected to spinning in the active spinning zone 3100. For better determining of the path of the cord 310 before entry into the sphere of the stationary reservoir 373 the cord 310 of each spinning member 31 is guided through the guiding member 376, which at the represented embodiment is formed of rotation guiding pulley, nevertheless it may be formed of another known guiding element.

At this embodiment the cord 310 is in a permanent motion and the liquid matrix 38 from the stationary reservoir 373 is carried out by the cord 310, which at its motion gets under the level of the liquid matrix 38 in the stationary reservoir 373 due to belting of the driving pulley 313. After leaving the perimeter of the driving pulley 313 the cord 310 enters with the liquid matrix 38 on its surface into its active spinning zone 3100, where spinning is running. The active spinning zone 3100 of the cord is finished by the stretching pulley 314, which is belted by the cord 310 and it returns through the guiding member 376 and the spattle 375 to perimeter of the driving pulley 313.

Figure 7:
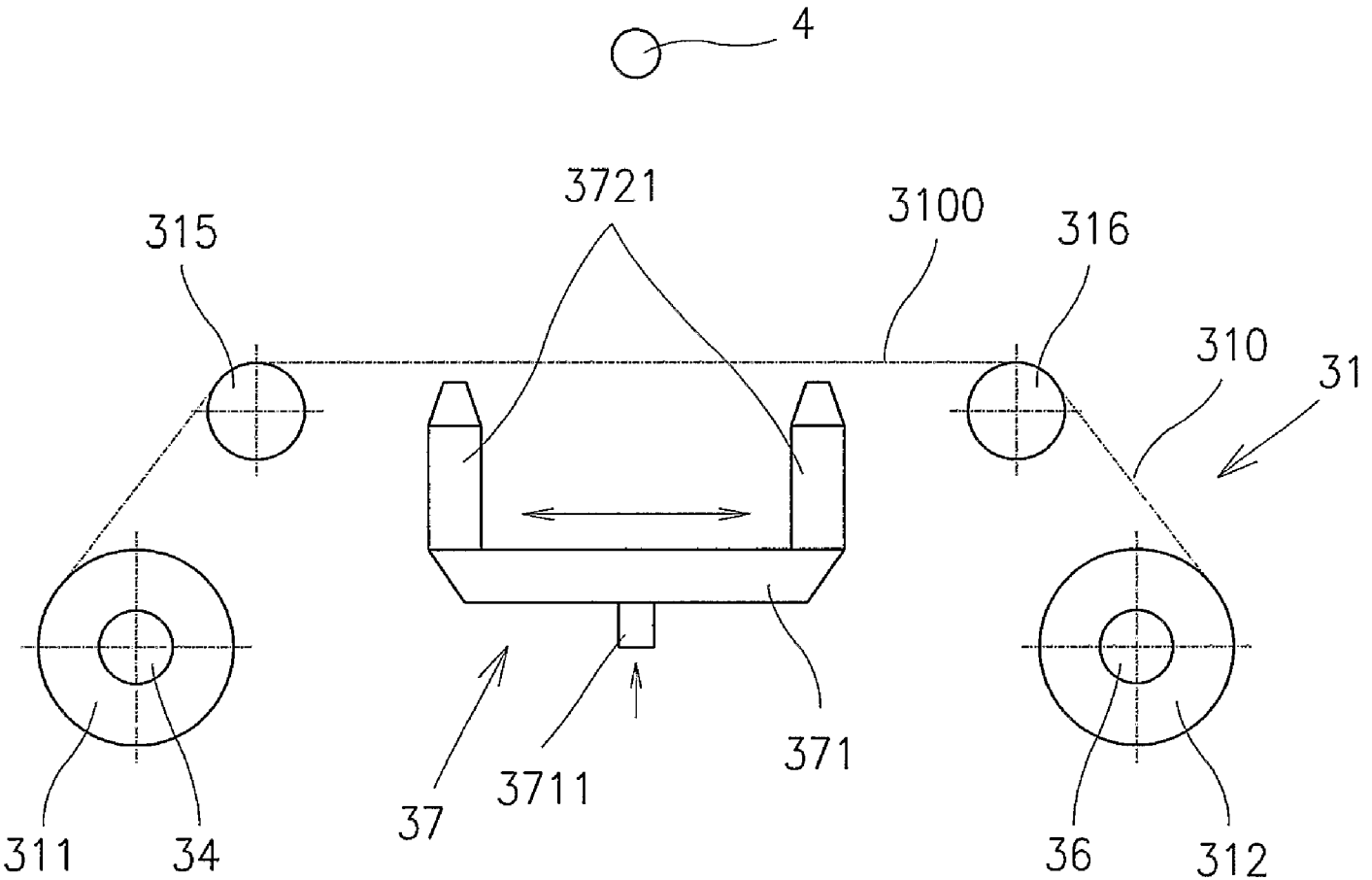

The FIG. 7 represents one spinning member 31, which comprises the unwinding reel 311, from which the cord 310 is guided through the rotatably mounted input guiding pulley 315 and rotatably mounted output guiding pulley 316 to the winding reel 312. The unwinding reel 311 is coupled with the unwinding drive 34 and the winding reel 312 is coupled with the winding drive 36. Part of the cord 310 between the input guiding pulley 315 and output guiding pulley 316 forms the active spinning zone 3100. From the side against the collecting electrode 4 to the active spinning zone 3100 is assigned the device 37 for application of the liquid matrix 38 to the active spinning zone 3100 of the cord 310, which comprises two capillary application means 3721 of the liquid matrix which are mounted on the spar 371 arranged reversibly displaceably along the active spinning zone 3100. The spar 371 is provided with inlet 3711 of the liquid matrix.

In case of need to apply the liquid matrix 38 to the active spinning zone 3100 of the cord 310, the spar 371 in a known manner sets into motion along the whole active spinning zone 3100 and into the capillary application means 3721 the fluid matrix 38 is brought, which is forced out from these means and it gets stuck on the active spinning zone 3100 of the cord 310. After application of a sufficient quantity of liquid matrix 38 the spar 371 stops and application of the liquid matrix 38 is interrupted. Once on the active spinning zone 3100 of the cord 310 quantity of the liquid matrix 38 drops to the minimum capable for spinning, when the spinning process is not finished yet due to lack of the liquid matrix 38, but it is already endangered, the spar 371 sets the device 37 for application of the liquid matrix again into motion. The spar 371 may perform one or more motions between its dead points. Motion of the spar 371, namely of the capillary application means 3721, is as frequent and fast so that in the area of the active spinning zone 3100 there is a sufficient quantity of the liquid matrix for spinning.

Figure 8:
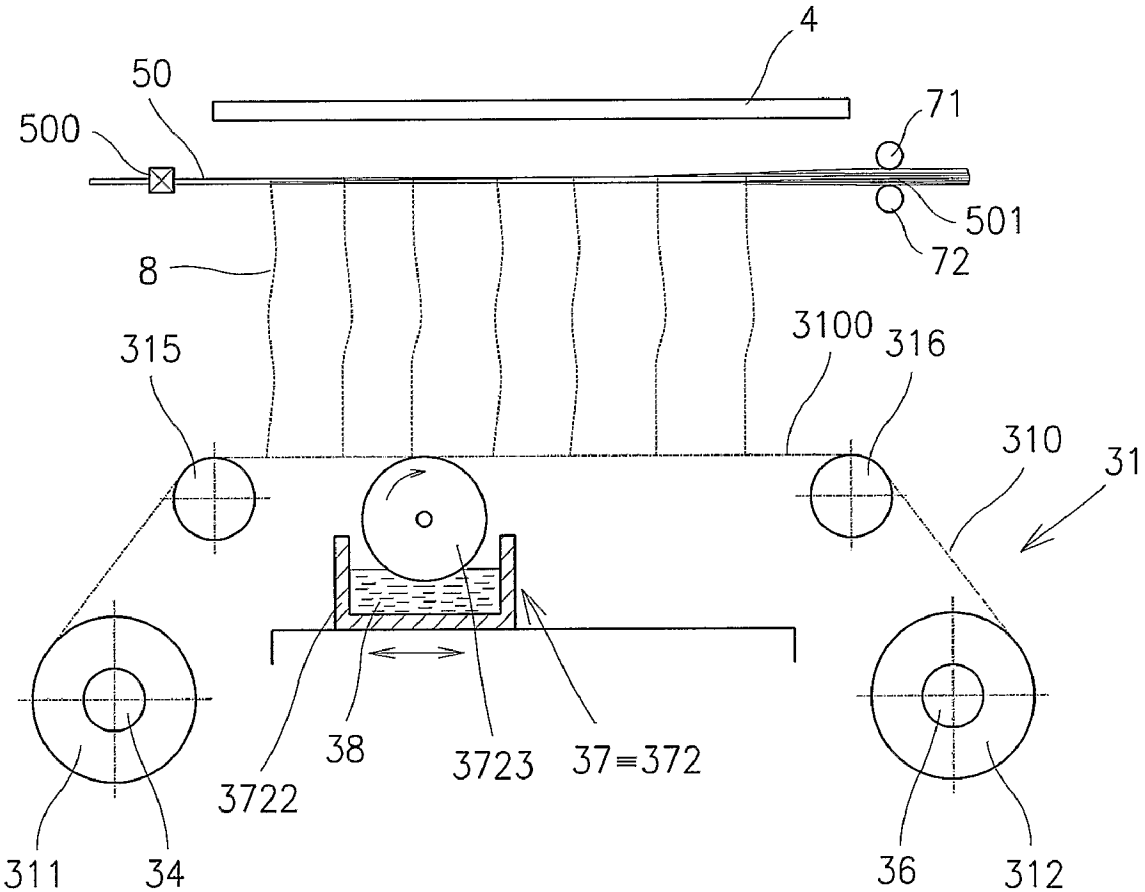

The FIG. 8 represents the exemplary embodiment of the spinning unit 2 for application of nanofibres 8 to the linear fibrous formation 50, as it is in detail described in the CZ PV 2007-179. The spinning member 31 of the spinning unit 2 is performed in the same way as in the embodiment according to the FIG. 7, only there is used other device 37 for application of the liquid matrix 38 to the active spinning zone 3100 of the cord 310. Parallel with the active spinning zone 3100 the collecting electrode 4 is mounted, and parallel with the collecting electrode 4 is also guided the linear fibrous formation 50, which before entry into the spinning space between the active spinning zone 3100 and the collecting electrode 4 is passing through the known device 500 for imparting the false twist and behind the spinning space it is taken off by means of the take-up rollers 71, 72. Application means 372 of the device 37 for application of the liquid matrix comprises from above opened reservoir 3722 of the liquid matrix 38, in which is rotatably mounted the application roller 3723 coupled with the not represented drive. Upper part of the application roller 3723 is in contact with active spinning zone 3100 of the cord 310. The reservoir 3722 is mounted displaceably along the active spinning zone 3100 of the cord 310 and it is coupled with the known not represented drive, that secures its reversible continuous or interrupted motion under the active spinning zone 3100. Requirements as to motion of the reservoir 3722 with the application roller 3723 are identical as at the preceding embodiments.

Figure 9:
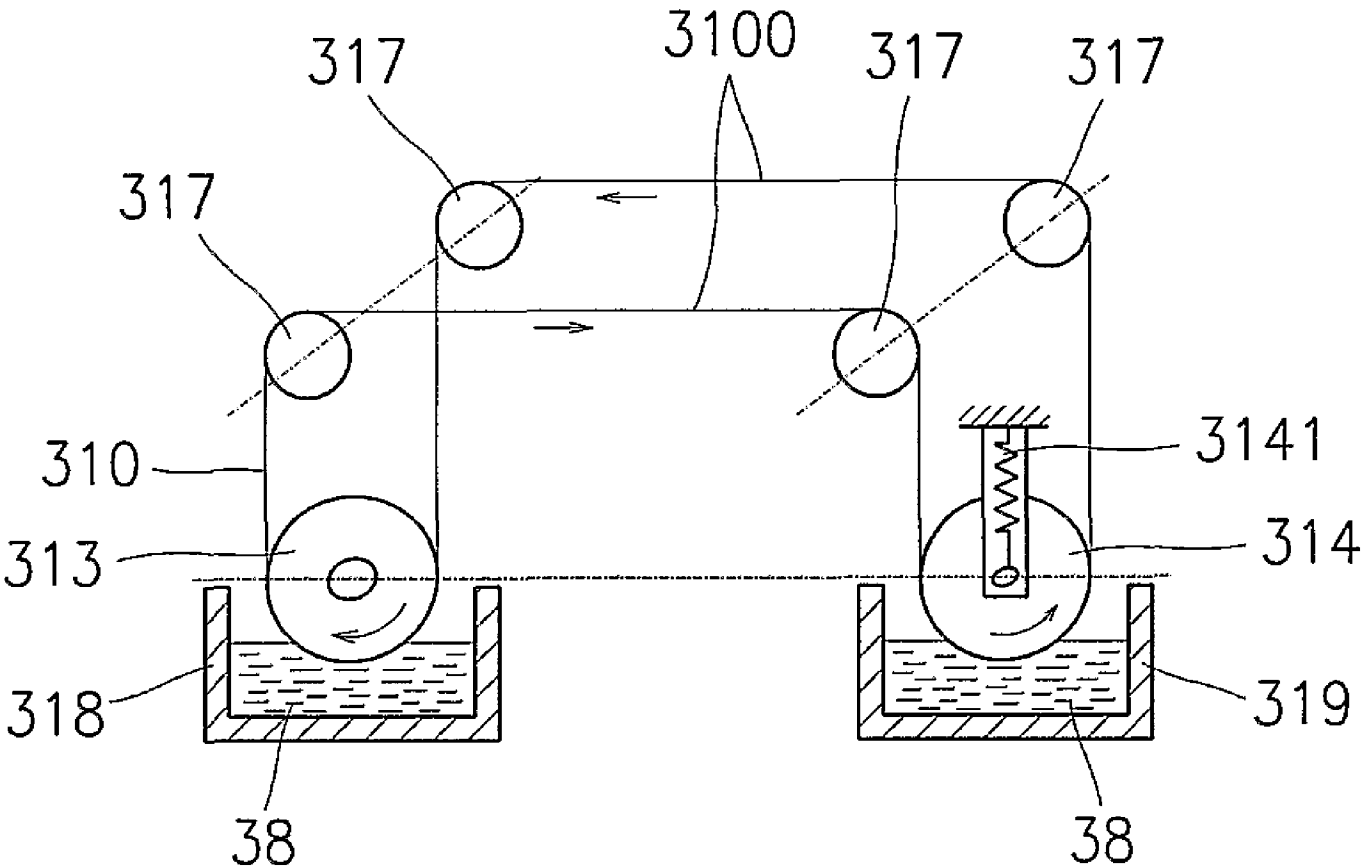

The FIG. 9 schematically represents embodiment of the spinning member 31 with two active spinning zones 3100. Endless cord 310 is belted around the driving pulley 313 and the stretching pulley 314. Between them it is guided via the guiding pulley 317, while the guiding pulleys 317 on the side from the driving pulley 313 are axial and their common axis is arranged above the driving pulley 313 parallel with the plane inlaid by this driving pulley 313 and it is perpendicular to direction of rotation axis of the driving pulley 313. The guiding pulleys 317 on the side of stretching pulley 314 are axial and their common axis is arranged above the stretching pulley 314 parallel with the plane inlaid by this stretching pulley 314 and it is perpendicular to the direction of rotation axis of the stretching pulley 314. The driving pulley 313 is rotatably mounted in the first reservoir 318 of the liquid matrix and it extends by a section of its perimeter under the level. The stretching pulley 314 is rotatably mounted in the second reservoir 319 of the liquid matrix and it extends by a section of its perimeter under the level, while the liquid matrixes 38 in both reservoirs may differ one from another. The cord 310 in each of its active spinning zone 3100 moves in opposite direction. This arrangement of spinning member enables various variants of solution, for which there are two active spinning zones 3100, that are preferably arranged in one plane and in case of more spinning members 31 arranged side by side in the spinning electrode 3, all active spinning zones 3100 of all spinning members are in one plane. Nevertheless in the not represented embodiment each spinning zone of one spinning member 31 may be arranged in another plane.

According to another not represented example of embodiment the spinning member 31 contains one cord 310 of finite length or the cord 310 infinite, that comprises more than two active spinning zones 3100, such embodiment is more demanding as to the structure than the described examples of embodiments, nevertheless it falls within the scope of invention.

Within the scope of invention also fall all combinations of the described embodiments and their modifications arisen especially by substitution of part of the devices or part of the elements of the devices by equivalents or by similar parts or by parts with the same or similar function, which especially relates to various possible variants of the device 37 for application of liquid matrix, wiping-off means 3142 and spattles 375, arrangement of spinning members 31 and their parts, their drive, etc.

LIST OF REFERENTIAL MARKINGS

1 spinning chamber
11, 12 insulation partition
2 spinning unit
3 spinning electrode

31 spinning member
310 cord
3100 active spinning zone of the cord
311 unwinding reel
312 winding reel
313 driving pulley
3131 shaft of driving pulleys
3132 drive of driving pulleys
314 stretching pulley
3141 stretcher
3142 wiping-off means of the liquid matrix
3143 auxiliary reservoir
315 input guiding pulley
316 output guiding pulley
317 guiding pulleys
318 first reservoir of liquid matrix
319 second reservoir of liquid matrix
32 carrying body
321 support
33 unwinding shaft
34 unwinding drive
35 winding shaft
36 winding drive
37 device for application of liquid matrix
370 device for wiping-off the liquid matrix
371 spar
3711 inlet of liquid matrix
372 application means
3721 capillary application means
3722 from above opened reservoir of the fluid matrix
3723 application roller
3724 drive of application roller
373 stationary reservoir
374 waste reservoir
375 spattle
376 guiding member
38 liquid matrix
4 collecting electrode
5 substratum material
51 nanofibrous layer
52 direction of motion of substratum material
61, 62 feeding roller
71, 72 take-up roller
8 nanofibres

The invention claimed is:

1. A method for electrostatic spinning liquid matrix in an electrostatic field between at least one spinning electrode and a collecting electrode positioned opposite in a first direction with respect to the at least one spinning electrode, while one of the electrodes is connected to a first pole of a high voltage source and a second electrode of the electrodes is connected to an opposite pole of the high voltage source or is grounded, the method comprising:

subjecting the liquid matrix on an active spinning zone on a surface of a cord of a spinning section of the spinning electrode to the electrostatic spinning through the electrostatic field, wherein the active spinning zone of the cord during the electrostatic spinning has a stable position toward the collecting electrode; and delivering the liquid matrix to the active spinning zone of the cord by application to the active spinning zone of the cord or by motion of the cord in direction of its length, wherein the cord moves in a second direction along a length of the cord while the liquid matrix is on the cord.

2. The method according to the claim 1, wherein the liquid matrix is applied on the active spinning zone of the cord in the electrostatic field during the electrostatic spinning, the method further comprising wiping off from the cord liquid matrix devalued by spinning and/or by effect of the surrounding atmosphere.

3. The method according to the claim 2, wherein the liquid matrix is applied on the active spinning zone of the cord during intermittent intervals and the devalued liquid matrix is wiped off the cord from time to time.

4. The method according to the claim 2, wherein the wiping off comprises:

wiping off simultaneously active spinning zones of the cords arranged side by side in one plane; and wiping off active spinning zones that follow one another such that at least one active spinning zone of the cord remains with applied liquid matrix so as to continue the electrostatic spinning.

5. The method according to the claim 3, wherein the wiping off comprises:

wiping off simultaneously active spinning zones of the cords arranged side by side in one plane; and wiping off active spinning zones that follow one another such that at least one active spinning zone of the cord remains with applied liquid matrix so as to continue the electrostatic spinning.

6. The method according to the claim 1, wherein the liquid matrix is applied to the active spinning zone of the cord by discontinuous motion of the cord.

* * * * *